US005097901A

United States Patent [19]

Klaeger

[11] Patent Number: 5,097,901

[45] Date of Patent: Mar. 24, 1992

[54] APPARATUS FOR REMOVING FLUIDS FROM A WELL

[76] Inventor: Joseph H. Klaeger, P.O. Drawer 445, Hondo, Tex. 78861

[21] Appl. No.: 561,894

[22] Filed: Aug. 2, 1990

[51] Int. Cl.[5] ..... E21B 19/08; E21B 37/10; E21B 43/00

[52] U.S. Cl. ..... 166/68; 166/53; 166/72; 166/105; 254/270; 254/379

[58] Field of Search ..... 166/369, 76, 79, 80, 166/85, 91, 92, 93, 177, 72, 77.5, 68.5, 105, 106, 153, 154, 155, 156, 202; 254/379, 378, 323, 270, 269

[56] References Cited

U.S. PATENT DOCUMENTS 3,989,106 11/1976 Taylor ..... 166/176
4,585,061 4/1986 Lyons, Jr. et al. ..... 166/77

*Primary Examiner*—William P. Neuder
*Attorney, Agent, or Firm*—Vaden, Eickenroht, Thompson & Boulware

[57] ABSTRACT

An improved mobile pumping apparaus for producing fluids from, for instance, shallow and/or slow-flowing marginal oil wells. The invention comprises a boom assembly which is adapted for mounting on a tractor, truck, or other vehicle having a standpipe mounted on the front thereof which is lowered into engagement with a wellhead and a winch having a cable attached at one end thereto, the other end of the cable extending down into the standpipe and having a swab bar attached thereto. The swab bar is provided with a heavy lead weight, so that the swab bar will sink down into the fluid as the cable is wound off of the winch, and a plurality of cups for lifting the fluid up out of the well when the direction of the winch is reversed. The oil is lifted up out of the well into the standpipe and on into a hose for collection in a storage tank. The boom is provided with a telescoping member and a hydraulic cylinder having a hook mounted on the ram thereof for opening the well from which the fluid is to be lifed, the boom telescoped outwardly to align the standpipe with the wellhead, and the well closed, all without moving the vehicle to which the boom assembly is mounted.

The swab bar attached to the end of the cable is configured so as to decrease the likelihood that the swab bar lodge in the well, and the winch is mounted on a carriage moveable between a first operative position and a second position for freeing the swab bar when struck in the well. The standpipe is also pivotedly mounted to the boom assembly to prevent damage to the standpipe or the wellhead in the event the operator attempts to drive away from the wellhead before the standpipe has been raised out of engagement with the wellhead. The pivotal mounting also serves to prevent damage to the standpipe when the winch is moved from first position to second position during attempts to dislodge the swab bar from the well.

18 Claims, 4 Drawing Sheets

APPARATUS FOR REMOVING FLUIDS FROM A WELL

BACKGROUND OF THE INVENTION

The present invention relates to, and is an improvement of, the mobile pumping apparatus described and claimed in my prior U.S. Pat. No. 4,751,969, hereinafter referred to as the '969 patent. The invention relates generally to an apparatus for removing fluids from a well. More particularly, the present invention relates to a mobile apparatus capable of lifting fluids, particularly oil, out of a well using a swab mounted on the free end of a cable which is run down the well and then retrieved, bringing the fluid up with it, and collecting and storing the fluid as it is removed from the well. Such an apparatus is also of considerable utility for use in cleaning and other maintenance operations in oil wells. The improvements described herein facilitate the manufacture of the apparatus, increase reliability, decrease the likelihood of damage to the well or the sticking of the swab in the well, and promote efficient removal of fluid from a well.

Although the apparatus described in the '969 patent has given (and continues to give) years of dependable service, that very experience has demonstrated certain areas in which certain disadvantages and/or limitations have been identified. For instance, the apparatus described in the '969 patent requires that the entire front end of the apparatus, e.g., the standpipe and boom assembly, be moved by a combination of hydraulics and movement of the vehicle to which the apparatus is mounted to align the standpipe into which the fluid flows as it is removed from the well with the wellhead. It is a novel feature of the boom assembly of the present invention that the standpipe is mounted to a telescoping boom which includes a hydraulic cylinder for extending the standpipe into position over the well, after picking up the well cover using the boom assembly of the present invention without re-positioning the vehicle to which the boom assembly is mounted. These novel features facilitate speedy removal of fluid from a well. The economics of removing oil from stripper wells (wells which produce less than about 10 barrels a day) requires that extraction be accomplished quickly.

Not only does the present invention incorporate an improvement in the boom, but also improvements to the standpipe assembly help to make the present invention less expensive to build and operate. The standpipe assembly of the present invention includes a standpipe which can be raised into and out of engagement with a wellhead, thereby eliminating the necessity for heavy hydraulics capable of pivoting the entire standpipe assembly into and out of engagement with the wellhead as is the case with the apparatus described in my prior '969 patent. Not only does this construction speed the alignment of the standpipe over the wellhead by eliminating the arc through which the standpipe assembly pivots in the case of the apparatus described in my prior patent, but also the elimination of the heavy hydraulics results in overall weight savings and the elimination of unnecessary complication, reducing fabrication costs and increasing economy of operation.

The present invention also contemplates improvements to the swab bar of the '969 patent to decrease the likelihood that the swab bar will lodge down in the well. The swab bar described in the '969 patent occasionally lodges in a well with the swab cups mired in the sand. The boom assembly of the present invention includes a swab bar with a lead base as the leading part of the swab bar. The heavy lead base is therefore the first portion of the swab bar to encounter any sand which may be present and either break the sand loose or stop the swab bar before the swab cups become lodged in the sand.

Even with these improvements to the swab bar, experience has demonstrated that the swab bar still occasionally lodges in the well. The boom assembly of the present invention therefore includes a further improvement for remedying that eventuality in the form of the mounting of the winch on a carriage movable by a hydraulic cylinder between first and second positions. In this manner, additional upward force can be exerted on the swab bar beyond that which the winch is capable of exerting by sliding the winch carriage from first to second positions to assist in either dislodging the swab bar or literally pulling the swab cups off of the swab bar, thereby freeing the swab bar.

These improvements to the swab bar also make possible certain improvements to the slack detection means described in my prior patent. Specifically, because the improved swab bar is more likely to penetrate, for instance, accumulated sand in the well and is, in general, less susceptible to downhole conditions, it is possible to detect smaller changes in the tension in the cable from which the swab bar is suspended. To take advantage of that capability, the pulley which rides on the cable and which comprises a primary portion of the slack detection means has been repositioned on the cable from the horizontal portion of the cable to the vertical portion of the cable, thereby increasing the sensitivity of the slack detection means.

It is, therefore, a primary object of the present invention to improve upon the invention described in the '969 patent.

Another object of the present invention is to provide an apparatus that is more easily and inexpensively manufactured and operated than the apparatus described in that prior patent.

Another object of the present invention is to provide a means for the operator to quickly remove a well cover remove the oil from the well, open and close a wellhead valve, and/or place the well cover back on the well, all without the need for moving the vehicle or for the operator to leave the vehicle.

Another object of the present invention is to provide an apparatus that will reduce the probability of the sticking of the swab bar in the well, for instance, when the swab bar encounters sand which may be present in the well.

Another object of the present invention is to provide the means for applying more pulling power to the cable than is produced by the winch onto which the cable is wound to assist in removing the swab bar when stuck in the well.

Other objects of the present invention will be apparent to those skilled in the art from the following detailed description of the invention.

SUMMARY OF THE INVENTION

The present invention achieves these objects by providing a boom assembly for cleaning, maintaining and producing fluid from shallow wells comprising a boom adapted for mounting to a mobile support means, a winch mounted on the mobile support means at one end of the boom and having a cable attached thereto, and a standpipe mounted to the boom having means mounted thereto for raising and lowering the standpipe into and out of engagement with a wellhead. A support pulley is mounted to the boom for routing the cable attached to the winch along the boom, around the support pulley, and down into the standpipe. Also provided is means operably connected to the winch for maintaining a relatively constant tension on the cable while the cable is being wound off the winch into the well. A swab bar is mounted on the free end of the cable for lowering into the well engaged by the standpipe for sinking down through the fluid in the well as the cable is wound off of the winch and then for lifting the fluid out of the well when the cable is wound back onto the winch, the fluid passing up out of the well into the standpipe. Also provided is means in fluid connection with the standpipe for receiving the fluid lifted out of the well by the swab bar.

DETAILED DESCRIPTION OF THE INVENTION

Figure 1:
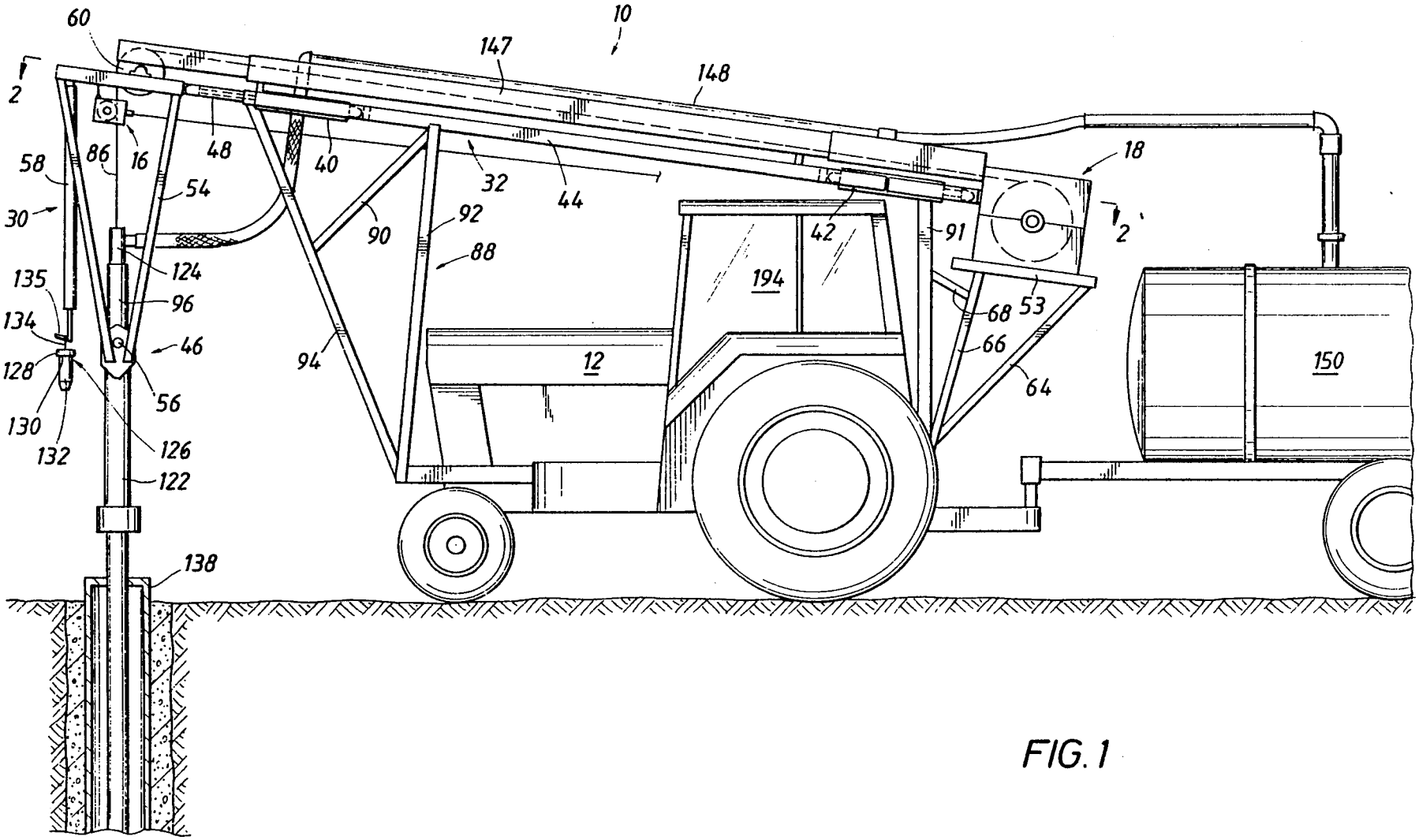
FIG. 1 is a side view of a presently preferred embodiment of the boom assembly of the present invention mounted on a tractor.

Referring to FIG. 1, there is shown a preferred embodiment of the boom assembly of the present invention, indicated generally by the reference numeral 10. One of the main advantages of the boom assembly 10 is that it is adapted for mounting to any convenient mobile support means such as the tractor shown at reference numeral 12 in FIG. 1 or a truck such as is shown in the '969 patent. The boom assembly 10 is comprised of several component parts mounted on the tractor 12 including the standpipe assembly 46, a well opening means 30, telescoping boom 32, cable slack detection means 16, the winch indicated generally at reference numeral 18, tank 150 and the swab bar 140 (not shown in FIG. 1).

Because the boom assembly 10 of the present invention is an improvement of the invention disclosed in U.S. Pat. No. 4,751,969, several of the elements of the present invention are the same as those disclosed in the '969 patent. The disclosure of that patent is, therefore, incorporated herein in its entirety by this specific reference to that patent, and the description of those elements is omitted here.

Figure 2A:
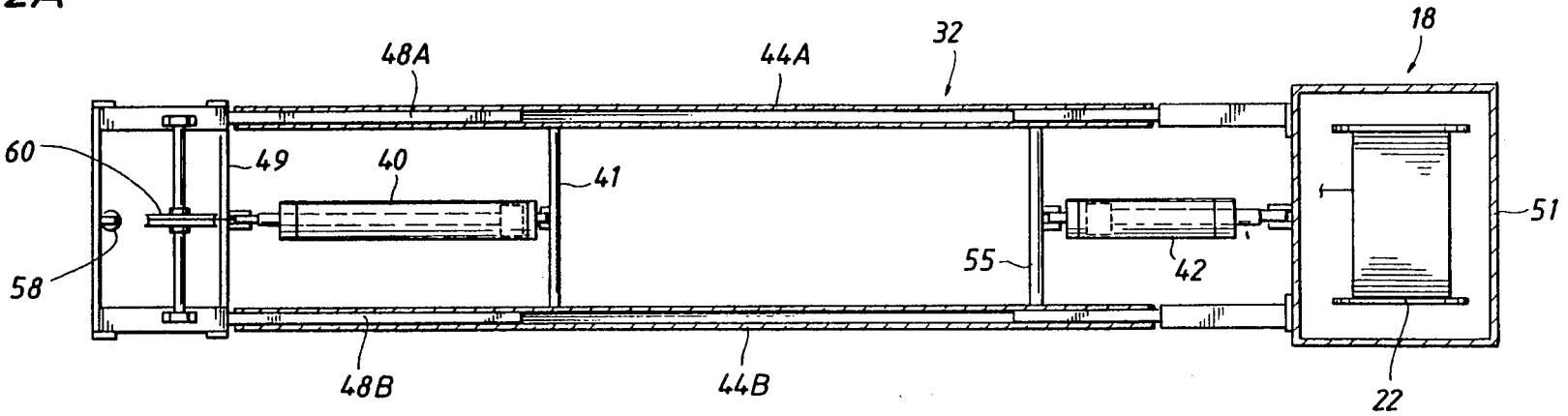
FIG. 2*a* is a top view of the telescoping boom of the boom assembly of FIG. 1 in retracted position.
Figure 2B:
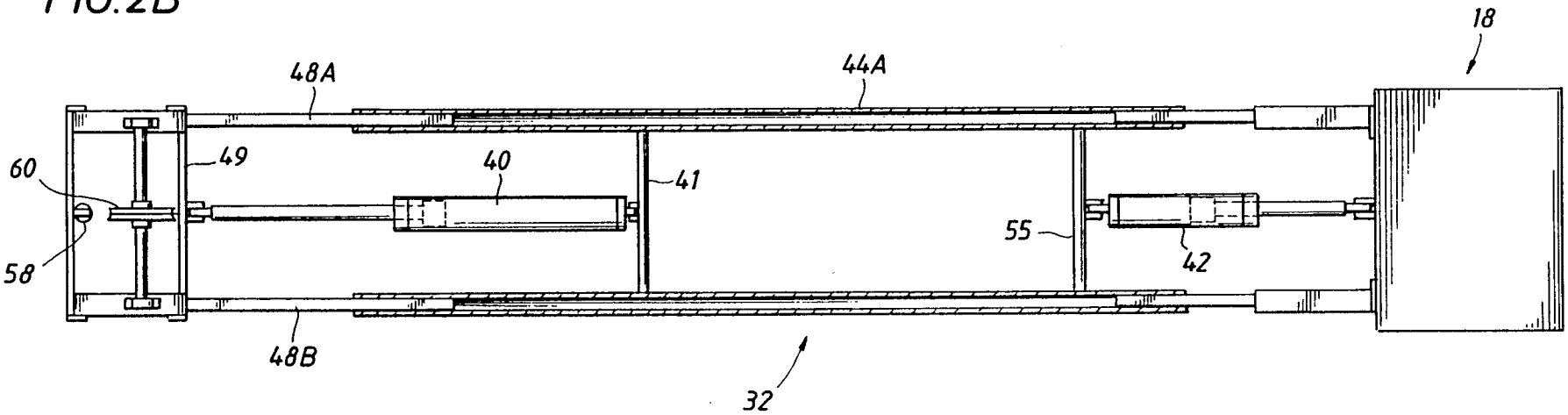
FIG. 2*b* is a top view of the telescoping boom of the boom assembly of FIG. 1 in the extended position.

Referring to FIGS. 1 and 2A and 2B, the boom 32, which is adapted for mounting on top of the cab 194 of tractor 12, is shown in extended position in FIG. 2B and retracted position in FIG. 2A. The boom 32 is supported on tractor 12 by a frame, indicated generally at reference numeral 88, comprised of braces 90, 92, and 94 as well as the column 91 which is attached to the rear of tractor 12. The two stationary members 44*a* and 44*b* comprising boom 32 are positioned in spaced parallel relationship to each other, and each is provided with telescoping members 48*a* and 48*b* to which the main support pulley 60 is mounted. A hydraulic cylinder 40 is mounted between a bracket 41 and the cross bar 49 for extending the telescoping members 48 out of stationary members 44.

At the other end of the boom 32 is the winch 18, which is mounted to the boom 32 or to the vehicle or tractor 12, e.g., remotely from boom 32, by the struts 64, 66, and 68. The details of the construction of the winch 18 are described in the above-incorporated '969 patent and are, therefore, omitted here. Winch 18 is mounted on a carriage 51 for reciprocation along the rails 53 secured to struts 64 and 66. A second hydraulic cylinder 42 is secured between the carriage 51 and bracket 55 for moving the winch 18 on carriage 51 between first and second positions for freeing the swab 140 when swab 140 sticks in a well such as the well 138 to which the standpipe housing 122 is engaged. In this manner, considerable additional force can be generated to help free the swab 140 from the well than can be generated by the winch 18 alone.

Figures 3, 4:
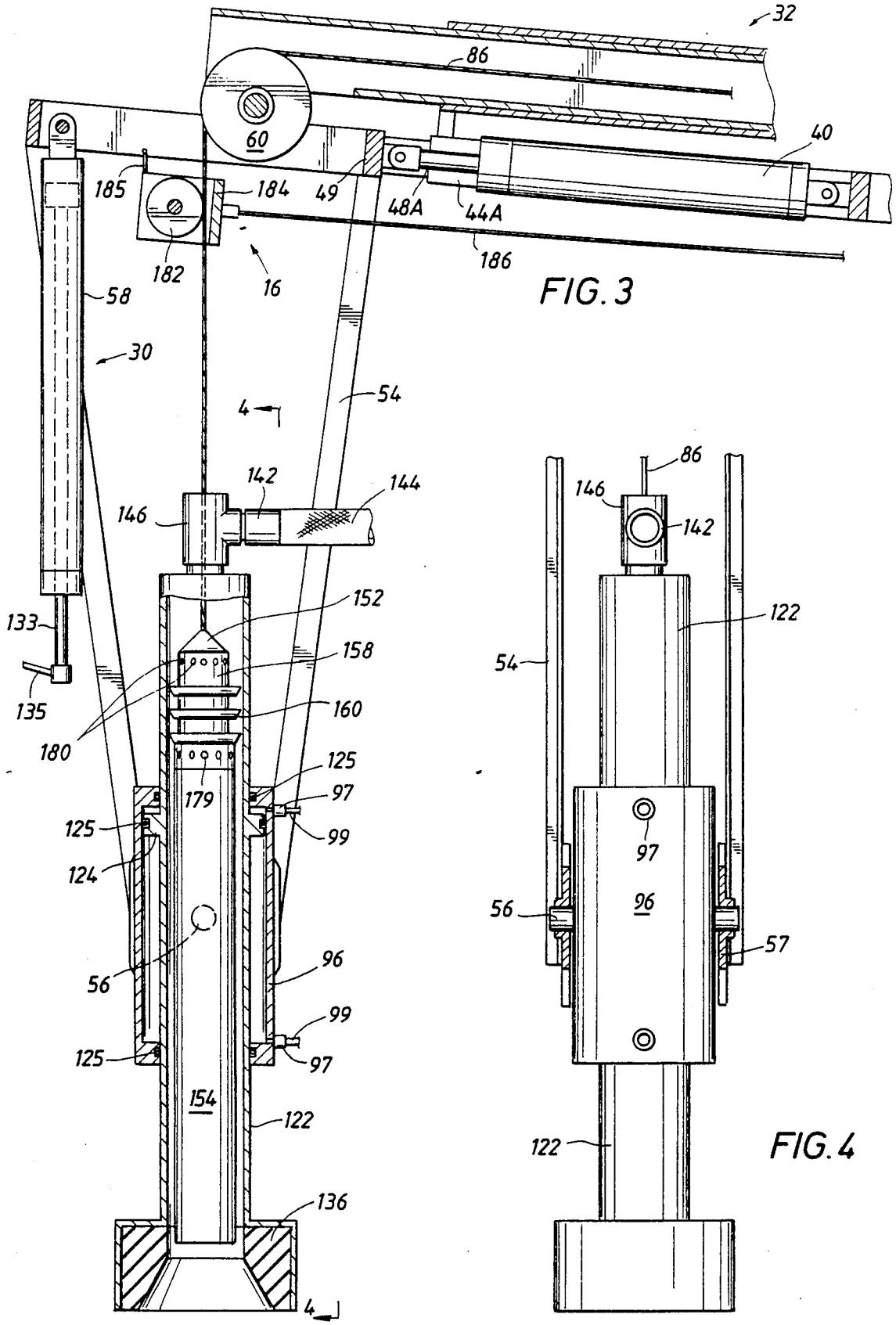
FIG. 3 is an enlarged, partially cutaway, side view of the standpipe assembly and front end of the boom assembly of FIG. 1.
FIG. 4 is an enlarged, front view of the standpipe of the boom assembly of FIG. 1.

Referring to FIG. 3, the standpipe assembly 46 is shown in detail. Struts 54 are integral with the cross bar 49 mounted on the telescoping members 48 of boom 32 and standpipe assembly 46 is pivotally mounted to struts 54 on pins 56 which are integral with standpipe housing 96 and extend through holes (not numbered) in sleeve 57 (see FIG. 4) on both sides of standpipe 122. The pivotal connection formed by pins 56, sleeve 57, and struts 54 prevents damage to the standpipe 122 and/or wellhead 138 from relative movement therebetween, i.e., when the operator does not raise the standpipe 122 sufficiently before driving off. Standpipe 122 passes through the standpipe housing 96 positioned in sleeve 57, which forms a cylinder, and piston 124 is integrally mounted to standpipe 122. Piston 124 is positioned within the cylinder formed by housing 96 for reciprocation therein for raising and lowering standpipe 122 into and out of engagement with wellhead 138. Appropriate fittings 97 for receiving hydraulic lines 99 and seals 125 on piston 124 and standpipe housing 96 are provided to effectuate the raising and lowering of standpipe 122.

Alternatively, standpipe 122 is slidably mounted in standpipe housing 96 and one or more hydraulic cylinders (not shown) is mounted to the outside of standpipe housing 96, the ram(s) of such hydraulic cylinders being affixed to standpipe 122 (the hydraulic cylinder could also be mounted to the telescoping members 48 of boom 32, but in such an arrangement, both the cylinder and the ram of the cylinder must be pivotally mounted to telescoping member 48 and standpipe 122, respectively, to maintain the pivotal capability of standpipe 122). Although such an arrangement functions in the same manner to achieve the same result as the structure described above, the hydraulic cylinder formed by the location of piston 124 within standpipe housing 96 represents the presently preferred embodiment because of the inexpensive nature of the fabrication thereof and the absence of any uneven or side-to-side forces on standpipe 122 during the extension or retraction thereof.

As described above, the main support pulley 60 routes the cable 86 along boom 32 around pulley 60 and down into standpipe 122. Cable slack detection means 16, in the form of a pulley 182 which rides on cable 86 and is journaled in reciprocating rod 184, is provided for braking the winch 18 to decrease the rate at which the cable 86 is wound off of winch 18 when swab bar 140 is not sinking down through the fluid 100 in the well to which standpipe 122 is engaged, thereby causing any slack in cable 86 to be taken up. A tether 185 is provided for suspending the pulley 182 from boom 32 on cable 86. Reciprocating rod 184 is operably connected to a control valve by a cable 186 and braking of winch 18 is accomplished in the same manner as described in the previously-incorporated '969 patent by the cable 186. The location of the pulley 182 on cable 86 between support pulley 60 and standpipe 122 provides for more sensitive detection of slack in the cable 86 than the location disclosed in the '969 patent.

Government environmental and safety regulations continue to proliferate to the point that all wells are now required to be capped, covered, or closed in a manner meeting certain minimum requirements, most importantly, that they be secure and not be capable of being easily removed from the wellhead. The present invention therefore includes a new and novel well opening means 30 mounted on the boom 32 for opening a well as a continuous operation of the apparatus 10. Referring again to FIG. 1, an exemplary well closure is shown in the form of the well cover 126. Well cover 126 is comprised of a cap 128, the bottom margin 130 of which forms a shoulder for resting on wellhead 138, a lead bar 132 mounted on the bottom of cap 128, and a lifting eye 134 mounted on the top of cap 128. The weight of lead bar 132 prevents easy removal of well cover 126 from wellhead 138, and the shoulder 130 effectively seals the wellhead 138. This structure allows the integration of a well opening means, indicated generally at reference numeral 30, with the boom assembly 10 of the present invention as follows.

Well opening means 30 is comprised of a hydraulic cylinder 58 mounted to the telescoping members 48 of boom 32. The ram 133 of hydraulic cylinder 58 is provided with a hook 135 for engaging the lifting eye 134 of well cover 126. The structure of well opening means 30 and well cover 126 allows the operator to approach a wellhead 138, extend the ram 133 of hydraulic cylinder 58 to the level of the lifting eye 134, activate the hydraulic cylinder 40 of boom 32 to extend the telescoping members 48 to which hydraulic cylinder 58 is mounted, thereby engaging the lifting eye 134 with the hook 136 mounted on the ram 133 of hydraulic cylinder 58, lifting the well cover 126 off of wellhead 138, and then activating the hydraulic cylinder 40 again to extend the telescoping members 48, having the cross bar 49 mounted thereto, to align the standpipe 122 over wellhead 138, all without moving the position of vehicle 12 to which the boom assembly 10 is mounted. Note also that similar structure is used for opening and closing a wellhead or casing valve (not shown). Such valves are opened and closed by, for instance, rotation of a lever from horizontal to vertical, and by providing the lever with a loop or eye, the hook 135 is advantageously use for that purpose, again without requiring the operator to dismount from tractor 12. For purposes of convenience, and in contemplation of the many other ways in which a well can be capped, covered, or closed, structure such as the well cover 126 and the casing valve described herein is referred to throughout the present specification as a well closure; hence the use of the phrase "well opening means" to describe the structure indicated generally at reference numeral 30.

Figure 5:
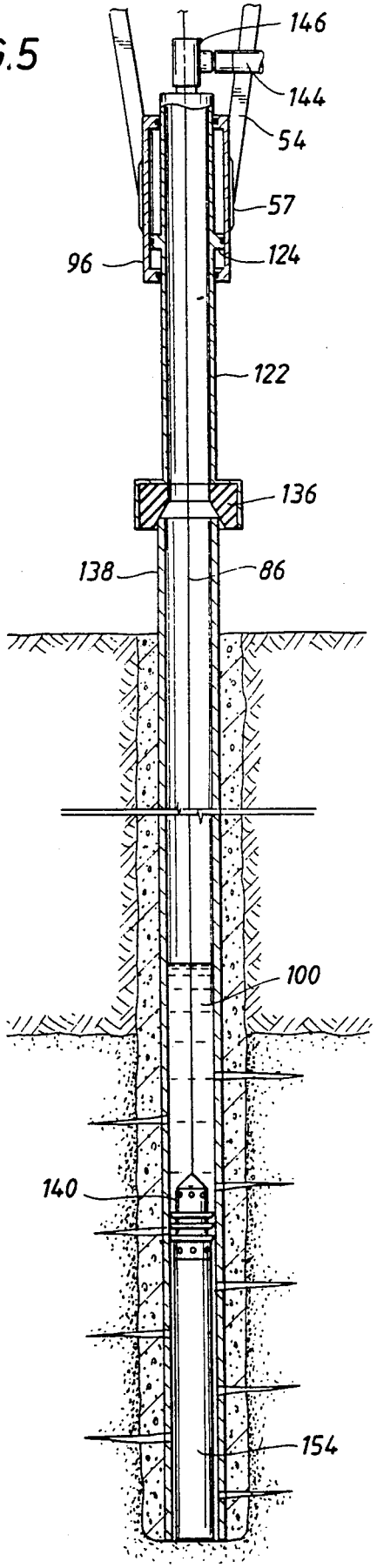
FIG. 5 is a longitudinal sectional view of the standpipe of FIG. 3 positioned on a wellhead with the swab bar extended down into the well.

Once the well cover has been removed and the standpipe 122 has been positioned over the wellhead 138, the standpipe 122 is lowered by action of the hydraulic cylinder formed by passage of standpipe 122, having piston 124 mounted thereto, through standpipe housing 96. The lower inside circumference of standpipe 122 is provided with a seal 136 made of NEOPRENE, NEOFAB, or other resilient material which seals against the top of the wellhead 138. Once in contact with wellhead 138, the interior of standpipe 122 is in fluid connection with the interior of the well (see FIG. 5).

Figure 6:
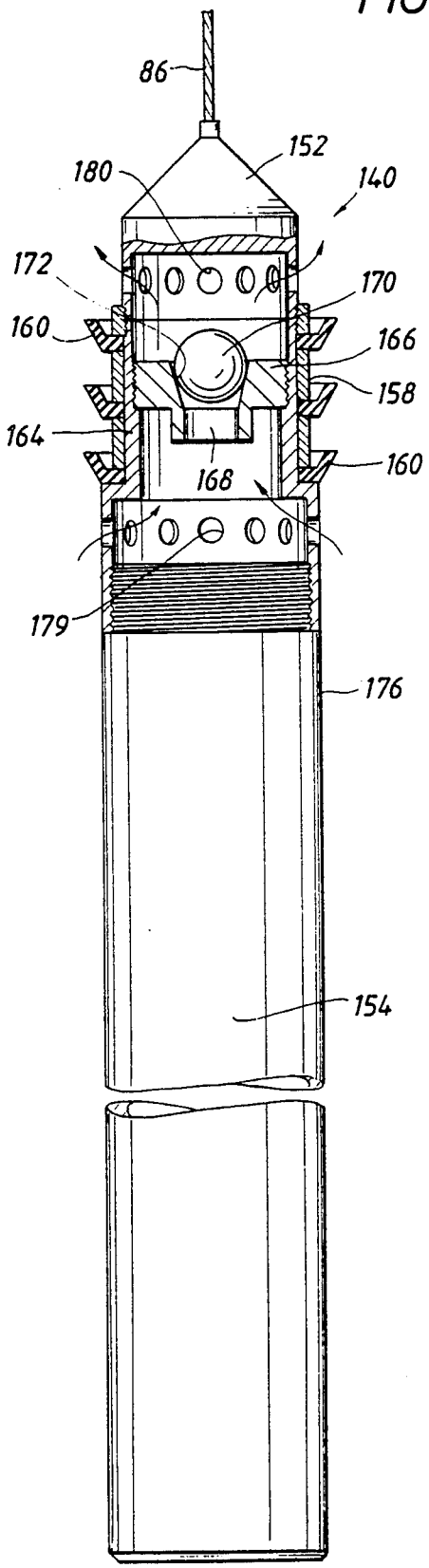
FIG. 6 is a longitudinal sectional view of the swab bar of FIGS. 3 and 5.

Referring to FIG. 6, swab 140 is shown in more detail. Cable 86 is attached to swab 140 by means of rope socket 152, which is integral with the mandrel 158. A collar 164 formed in the lower end of the mandrel 158 is threaded to receive the casing 176 for lead bar 154 which provides the weight needed to cause swab 140 to move downwardly through the fluid 100 in the well. Three swab cups 160, spaced along the length of mandrel 158, are shown for purposes of clarity, but as few as one and as many as will fit on the length of mandrel 158 may be used, depending on the amount and viscosity of fluid to be removed from the well. The bottom of mandrel 158 is provided with a plurality of inlet ports 179 through which fluid passes as swab 140 sinks into the fluid in the well, and fluid travels into the mandrel 158 up through orifice 168. The orifice 168 is sealed by a check valve comprising ball 170 and of valve seat 172. As the fluid travels upward through the mandrel 158, the valve is opened and the fluid passes around the ball 170 and out through the outlet ports 180. As the swab 140 is raised out of the well, the fluid flows back into the output ports 180 forcing the ball 170 back down onto the valve seat 172, thereby preventing the fluid from flowing back into the well and thus raising the fluid up into standpipe 122 and on into hose 144 as the swab 140 is raised.

A check valve 142 is mounted in hose 144 to prevent loss of fluid therefrom. Check valve 142 is a one-way valve which breaks the siphon which would otherwise allow fluid to flow back out of hose 144 and tank 150. To prevent the fluid from being lifted up out of the well and out of the top of the standpipe 122, an oil saver 146 such as is described in the '969 patent, which has a rubber doughnut (not shown) therein, is mounted to the top of standpipe 122 at the point at which cable 86 enters the standpipe 122. When hydraulic pressure is applied to that doughnut, it is forced against the cable 86 so that as oil is drawn upwardly and fluid cannot escape out the opening through which cable 86 passes. By monitoring the length of cable 86 which is reeled off of the reel 22 of winch 18, the operator can determine that swab 140 has sunk down into fluid 100 to a sufficient depth. When the swab 140 reaches that desired depth, the operator reverses the direction of rotation of the reel 22 so that the cable 86 will be wound back onto the reel 22, retrieving the swab 140 from the well.

The same safety and environmental regulations which were the genesis of the well closure and well opening means described above also require that oil raised out of the well not be allowed to drip into anything but a proper storage or processing facility. In spite of the use of the oil saver 146, oil does cling to cable 86 when the winch 18 is reversed to raise the oil out of a well, and that oil tends to drip off of cable 86 as cable 86 turns around pulley 60 onto the horizontal portion of its route along boom 32. Boom 32 is, therefore, provided with a shroud 147 which telescopes in and out with the telescoping members 48 of boom 32 upon activation of hydraulic cylinder 40, and at the other end of boom 32 upon activation of hydraulic cylinder 42, to catch and hold such drippings until they can be drained into a proper facility.

The swab cups 160 on mandrel 158 of swab 140 will each support approximately 100 feet of oil in a well of 4½ to 5½ inches in diameter. Consequently, if three of the cups 160 are placed on mandrel 158, a column of approximately 300 feet of oil can be lifted from the well. Wells of larger diameter require swabs of larger diameter. Once the direction of reel 22 has been reversed, the swab cups 160 catch and hold the oil, lifting it up out of the well, where it is funneled into the storage tank 150, e.g., into the standpipe 122, through check valve 142, hose 144, through the overhead pipe 148 up over the boom assembly 32 above the tractor cab 194. Fluid is routed overhead through pipe 148 to reduce the back pressure against the fluid as it comes out of the well.

Mandrel 158 of swab 140 is provided with a threaded insert 166 having an orifice 168 therein (FIG. 6). Depending upon the type of fluid to be raised out of the well with the present apparatus and the viscosity of that fluid, this threaded insert 166 may be replaced with an insert with an orifice 168 of different size. The ability to switch threaded inserts 166, thereby changing the size of the orifice 168, can be important in the case of high viscosity oil such as that which is often found in stripper wells. Even though some oil will pass between the edges of swab cup(s) 160 and the walls of the well as swab 140 sinks, most of the oil passes through orifice 168, consequently the size of orifice 168 has a considerable effect on the rate at which swab 140 sinks, which, in turn, affects the amount of slack in cable 86 which is sensed by cable slack detection means 16. The size of orifice 168 is also important because, if it is too large, swab 140 will not float momentarily on the oil when lowered into the well so that the operator will not be able to tell how deep into the fluid swab 140 has been lowered.

Once the operator has retrieved all the available fluid from the well, the standpipe 122 is raised out of engagement with the wellhead 138 and the operator proceeds to the next well to repeat the process until the storage tank 150 is filled. In the event that the swab 140 gets stuck in the well, the operator must attempt to dislodge the swab 140 without damaging the well or the swab 140. Unfortunately, as noted above the upward force provided by winch 18 sometimes is not sufficient to unstick the swab 140. In such operations, the hydraulic cylinder 42 is activated to provide the extra force necessary to unstick the swab in the well by sliding the winch 18 backwards, e.g. from first to second position.

Although the invention has been described in terms of the foregoing preferred embodiment, this preferred embodiment is described by example only, and the scope of the invention is not restricted to this preferred embodiment. Rather, the scope of the present invention is limited only by the following claims.

What is claimed is:

1. A boom assembly for removing fluid from a well comprising:

a boom adapted for mounting to a mobile support means;

a standpipe mounted to said boom for engaging a wellhead, said standpipe passing through a cylinder and having a piston mounted thereto the piston being positioned in the cylinder for reciprocation under the influence of hydraulic fluid for raising and lowering said standpipe into and out of engagement with the wellhead;

a winch adapted to be mounted to the mobile support means remotely from said standpipe and having a cable attached thereto;

a support pulley mounted to said boom for routing the cable attached to said winch along said boom around said support pulley and down into said standpipe;

a swab bar attached to the end of the cable and suspended below said support pulley in said standpipe and having a swab cup mounted thereto; and cable slack detection means comprising a pulley bearing against the cable between said support pulley and said standpipe and having a control cable attached thereto, said control cable being operably connected to a control valve for braking said winch when said swab bar is not suspended by the cable to slow the rate at which the cable is wound off of said winch and maintain relatively constant tension on the cable at all times.

2. The boom assembly of claim 1 wherein said winch is mounted on a carriage movable between a first operable position and a second position for freeing said swab bar when said swab bar sticks in the well to which said standpipe is engaged.

3. The boom assembly of claim 1 additionally comprising a seal mounted on the lower inside circumference of said standpipe for sealing against the wellhead for containing the fluid lifted out of the well by the swab cup mounted on said swab bar.

4. The boom assembly of claim 1 additionally comprising a pulley bearing against the cable between said support pulley and the standpipe and having a control cable attached thereto, said control cable being operably connected to a control valve for braking said winch when said swab bar is not sinking down through the fluid in the well thereby maintaining relatively constant tension on the cable at all times.

5. The boom assembly of claim 4 wherein said pulley is suspended by a tether from said boom.

6. The boom assembly of claim 1 additionally comprising a seal mounted on the lower inside circumference of the standpipe for sealing against the wellhead for containing the fluid lifted out of the well by said swab bar.

7. A boom assembly for removing fluid from a well comprising:

a boom adapted for mounting to a mobile support means;

a standpipe mounted to one end of said boom and having a piston mounted thereto, the piston being positioned in a cylinder for reciprocation therein to raise and lower said standpipe into and out of engagement with a wellhead;

a winch adapted to be mounted to the mobile support means at the end of said boom opposite said standpipe and having one end of a cable attached thereto, the other end of the cable extending along said boom and down into said standpipe; and a swab bar attached to the other end of the cable for lowering into a well when said standpipe is lowered into engagement with a wellhead for sinking down through the fluid in the well as the cable is wound off of said winch and then for lifting the fluid out of the well when the cable is wound back onto said winch, the fluid passing up out of the well into said standpipe.

8. The boom assembly of claim 7 wherein said standpipe is pivotally mounted to said boom.

9. The boom assembly of claim 7 wherein said boom additionally comprises a telescoping member and a hydraulic cylinder for extending and retracting said telescoping member, said standpipe being mounted to said telescoping member.

10. A boom assembly for removing fluid from a well comprising:

a boom adapted for mounting to a mobile support means;

a standpipe mounted to one end of said boom and having means mounted thereto for raising and lowering said standpipe into and out of engagement with a wellhead;

a winch adapted to be mounted to the mobile support means at the end of said boom opposite said standpipe and having one end of a cable attached thereto, the other end of the cable extending along said boom and down into said standpipe;

a swab bar attached to the other end of the cable for lowering into a well when said standpipe is lowered into engagement with a wellhead for sinking down through the fluid in the well as the cable is wound off of said winch and for lifting the fluid out of the well when the cable is wound back onto said winch, the fluid passing up out of the well into said standpipe; and a carriage on which said winch is mounted for moving between first and second positions for freeing said swab bar when said swab bar sticks in the well to which said standpipe is engaged.

11. The boom assembly of claim 10 wherein said boom additionally comprises a telescoping member and a hydraulic cylinder for extending and retracting said telescoping member, said standpipe extending means being mounted to said telescoping member.

12. The boom assembly of claim 10 wherein said standpipe extending means is pivotally mounted to said boom.

13. The boom assembly of claim 10 wherein said swab bar comprises a mandrel having a plurality of swab cups mounted thereto for bearing against the inside wall of the well into which said swab bar is lowered to raise the fluid in the well when the cable is wound back onto said winch and a weight bar located below said mandrel.

14. The boom assembly of claim 10 wherein said standpipe extending means comprises a piston to which the standpipe is mounted and a cylinder through which the standpipe passes, said piston being positioned within said cylinder for reciprocation therein under the influence of hydraulic fluid.

15. A boom assembly for removing fluid from a well comprising:

a boom adapted for mounting to a mobile support means and having a telescoping member and hydraulic cylinder mounted thereto for extending and retracting said telescoping member;

a standpipe mounted to the telescoping member of said boom and having means mounted thereto for raising and lowering said standpipe into and out of engagement with a wellhead;

a winch adapted to be mounted to the mobile support means at the end of said boom opposite said standpipe and having one end of a cable attached thereto, the other end of the cable extending along said boom and down into said standpipe; and a swab bar attached to the other end of the cable for lowering into a well when said standpipe is aligned with the wellhead by extending or retracting the telescoping member and lowered into engagement with the wellhead by said standpipe raising and lowering means for sinking down through the fluid in the well as the cable is wound off of said winch and then for lifting the fluid out of the well when the cable is wound back onto said winch, the fluid passing up out of the well into said standpipe.

16. The boom assembly of claim 15 wherein said standpipe raising and lowering means comprises a piston mounted to said standpipe and a cylinder through which said standpipe passes, said piston being positioned within said cylinder for reciprocation therein under the influence of hydraulic fluid.

17. The boom assembly of claim 15 additionally comprising means mounted on said telescoping member for opening a well when said telescoping member is retracted, thereby allowing the standpipe to engage the wellhead by extending said telescoping member without repositioning the mobile support means to which said boom is mounted.

18. The boom assembly of claim 17 wherein said well opening means opens a well by lifting a well cover off of the wellhead, said well cover comprising a heavy plug for resting in the well and having a lifting eye attached to the top thereof, said lifting eye being adapted for being engaged by said well cover lifting means.

* * * * *